US005183392A

United States Patent [19]

Hansen

[11] Patent Number: 5,183,392

[45] Date of Patent: Feb. 2, 1993

[54] COMBINED CENTRIFUGAL AND UNDERVANE-TYPE ROTARY HYDRAULIC MACHINE

[75] Inventor: Lowell D. Hansen, Jackson, Miss.

[73] Assignee: Vickers, Incorporated, Troy, Mich.

[21] Appl. No.: 354,372

[22] Filed: May 19, 1989

[51] Int. Cl.[5] ..... F04B 1/08; F04B 23/10; F04B 23/14

[52] U.S. Cl. ..... 417/203; 417/205; 417/219; 417/236

[58] Field of Search ..... 417/201-203, 417/205, 219, 236; 418/26, 27, 186

[56] References Cited

U.S. PATENT DOCUMENTS

| | | | |
|---|---|---|---|
| 1,128,579 | 2/1915 | Brousseau | 417/203 |
| 2,293,693 | 8/1942 | Wylie et al. | 417/203 |
| 2,348,428 | 5/1944 | Tucker | 418/186 |
| 3,107,628 | 10/1963 | Rynders et al. | 418/26 |
| 3,117,528 | 1/1964 | Rosaen | 418/26 |
| 4,601,641 | 7/1986 | Kuroyanagi et al. | 417/219 |

FOREIGN PATENT DOCUMENTS

| | | | |
|---|---|---|---|
| 460907 | 11/1949 | Canada | 418/26 |
| 812978 | 9/1951 | Fed. Rep. of Germany | 417/203 |

*Primary Examiner*—John J. Vrablik

*Attorney, Agent, or Firm*—Barnes, Kisselle, Raisch, Choate, Whittemore & Hulbert

[57] ABSTRACT

A rotary hydraulic machine having particular utility as a fuel pump for aircraft turbine engines that combines the desirable features of vane-type and centrifugal-type machines of similar character—i.e., high pressure positive displacement at low speed combined with improved reliability, package size and weight. This is accomplished, in accordances with a presently preferred embodiment of the invention, by providing a combined vane- and centrifugal-type pump that is configured to function as a pressure-compensated single-lobe vane pump for engine starting, and as a centrifugal pump at normal operating speed.

15 Claims, 3 Drawing Sheets

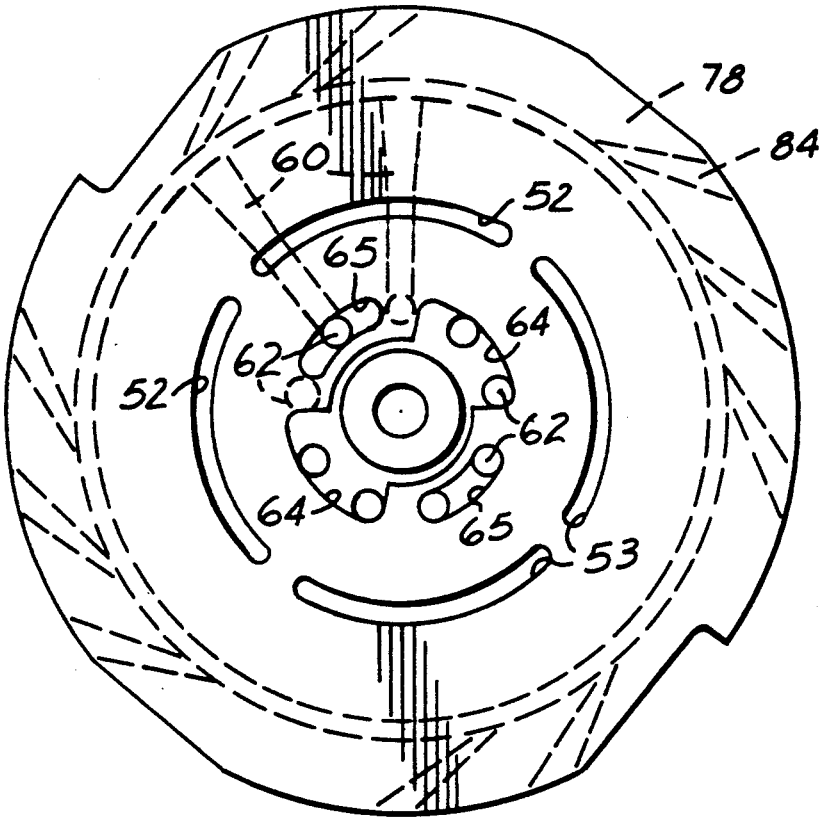
FIG.3
FIG.4
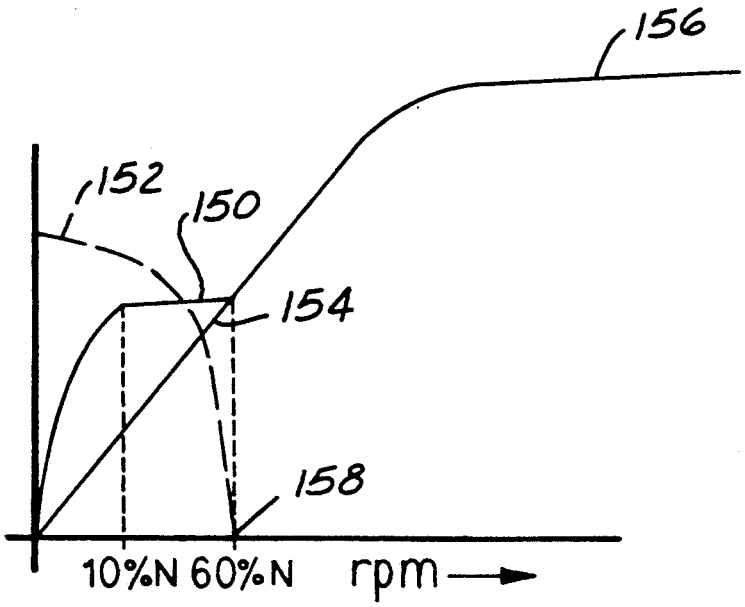

COMBINED CENTRIFUGAL AND UNDERVANE-TYPE ROTARY HYDRAULIC MACHINE

The present invention is directed to rotary hydraulic machines, and more particularly to a pressure-compensated combined centrifugal- and vane-type hydraulic pump.

BACKGROUND AND OBJECTS OF THE INVENTION

Positive displacement pumps are conventionally employed as fuel pumps for aircraft turbine engines in order to obtain sufficient fuel pressure for the engine during low speed starting conditions. Recent requirements to improve pump reliability, package size and weight have increased the need to employ centrifugal-type pumps in applications of this type. However, centrifugal hydraulic pumps, which rely upon high-speed rotation to obtain high output pressure, do not provide sufficient fuel pressure at the ten percent to fifteen percent speed range to permit engine starting.

System designs specifications typically require fuel pumps to operate at a specified flow rate with a vapor/-liquid inlet ratio of 0.45, and with a net positive suction pressure or NPSP, which is the pressure at the pump inlet above true vapor pressure of the fuel, of 5 psi. Newer system specifications, however, require the 0.45 vapor/liquid inlet ratio capability over a wider engine flow range, and may even require a 1.0 vapor/liquid ratio with intermittent all-liquid or all-vapor operation. Furthermore, the NPSP requirements have been increased to 5 psi over the entire engine flow range, and in some cases even 3 psi over the engine flow range.

It is therefore a general object of the present invention to provide a rotary hydraulic machine of the subject type that provides sufficient output pressure for use during low speed starting of aircraft turbine engines and other applications of similar type, while retaining desirable features of centrifugal pumps in terms of reliability, package size and weight.

It is another object of the present invention to provide a rotary hydraulic pump that is capable of satisfying flow requirements in aircraft turbine engine fuel delivery systems over an extended engine operating range. A further object of the present invention is to provide a fuel pump of the describe character that is economical and efficient in construction in terms of the stringent weight and volume requirements in aircraft applications, and that provides reliable service over an extended operating lifetime.

SUMMARY OF THE INVENTION

Briefly stated, the present invention contemplates a rotary hydraulic machine having particular utility as a fuel pump for aircraft turbine engines that combines the desirable features of vane-type and centrifugal-type machines of similar character—i.e., high pressure positive displacement at low speed combined with improved reliability, package size and weight. This is accomplished, in accordances with a presently preferred embodiment of the invention, by providing a combined vane- and centrifugal-type pump that is configured to function as a pressure-compensated single-lobe vane pump for engine starting, and as a centrifugal pump at normal operating speeds.

In accordance with a first important aspect to the present invention, a pressure-compensated rotary hydraulic machine comprises a housing, a rotor mounted for rotation within the housing and having a plurality of radially extending peripheral slots, and a plurality of vanes individually slidably mounted in the slots. An annular track ring is mounted within the housing and forms a radially inwardly directed vane track surrounding the rotor, and a cavity between the track and the rotor periphery. Fluid inlet and outlet passages in the housing are coupled to the cavity. A spring actuator is carried by the housing and engages the track ring so as to urge the ring to a position eccentric to the axis of rotation of the rotor. A fluid actuator is mounted within the housing at a position diametrically opposed to the spring actuator, and is responsive to fluid pressure at one of the inlet and outlet passages for moving the track ring against the force of the spring actuator toward a position coaxial with the rotor. The fluid actuator thus controls displacement of the undervane positive displacement feature of the machine as a function of fluid pressure. In the preferred application of the subject machine as a rotary hydraulic pump, the fluid actuator is coupled to the centrifugal pump output so as to decrease displacement of the undervane pump as pump output pressure increases to a pressure limit at which the track ring is coaxial with the rotor and the pump exhibits zero displacement. Pump operation at this time is totally centrifugal.

In accordance with a second important aspect of the present invention, the rotor includes a plurality of internal passages extending radially between the vanes slots from an open outer end at the periphery of the rotor to an inner end that receives inlet fluid. The track ring has a plurality of radial passages extending through the ring, preferably at an angle with respect to the axis of rotor rotation. Thus, in the zero-displacement position of the track ring coaxial with the rotor, the machine operates as a centrifugal machine, with the rotor vanes functioning to seal the rotor discharge from the rotor inlet and the track ring functioning as a diffuser. In the preferred implementation of the invention as a fuel pump for aircraft turbine engines, the pump shaft extends from the rotor housing for coupling to a source of motive power, and the fuel inlet is coaxial with the pump shaft and disposed on the opposite side of the rotor. A spiral fluid inducer is coupled to the pump drive shaft within the inlet for pressurizing inlet fluid fed to the rotor internal passages and thence to the rotor/ring fluid pressure cavity. Such fluid prepressurization helps urge the rotor vanes into sliding sealing engagement with the track ring and the side backup plates into close contact with the rotor, and also helps obtain high fluid pressure at low pump speed.

BRIEF DESCRIPTION OF THE DRAWINGS

The invention, together with additional objects, features and advantages thereof, will be best understood from the following description, the appended claims and the accompanying drawings in which:

FIGS. 2 and 3 are sectional views taking substantially along the respective lines 2—2 and 3—3 in FIG. 1; and FIG. 4 is a graphic illustration useful in describing operation of the invention.

DETAILED DESCRIPTION OF PREFERRED EMBODIMENT

Figure 1:
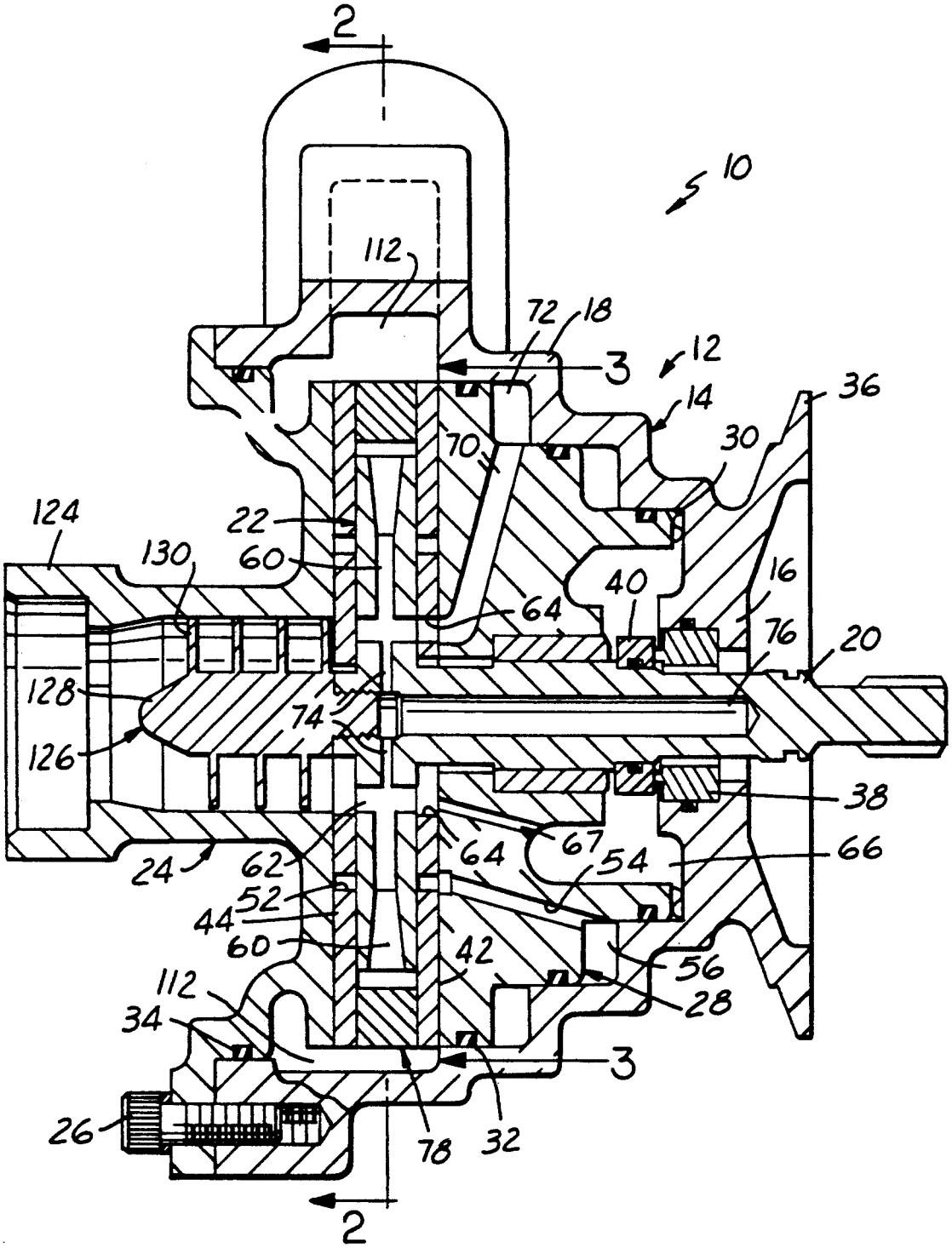
FIG. 1 is a sectional side elevational view of a rotary hydraulic machine in accordance with a presently preferred embodiment of the invention.

The drawings illustrate an aircraft engine fuel pump 10 in accordance with a presently preferred implementation of the invention as comprising a housing 12 formed by a hollow cup-shaped enclosure or shell 14 having a base 16 and an outwardly stepped sidewall 18. A drive shaft 20 projects from base 16 coaxially with shell 14 and has a disc-shaped pump rotor 22 formed integrally therewith. A rear backup plate 24 is affixed by bolts 26 to the open edge or lip of shell 14. A front backup plate 28 is slidably positioned within shell 14 in opposition to rear backup plate 24, and is resiliently urged toward backup plate 24 by the preload spring 30 positioned between front backup plate 28 and base 16 of shell 14. The periphery of backup plate 28 is stepped identically with the surrounding shell, and is slidably sealed with respect thereto by a plurality of O-rings 32. Likewise rear backup plate 24 is sealed with respect to shell 14 by an O-ring 34. A pump mounting flange 36 integrally projects radially outwardly from base 16 of shell 14 coaxially with the axis of rotation of shaft 20. A shaft seal 38 carried by shell base 16 cooperates with a mating ring 40 on shaft 20 for sealing the shaft opening through shell 14.

A front port plate 42 is affixed by suitable pins (not shown) to front backup plate 28. A complementary rear port plate 44 is affixed to rear backup plate 24. Port plates 42, 44 are parallel to each other and slidably approach the parallel side faces of rotor 22, and track ring 78 to maintain close running clearances with these faces port plate 42 is resiliently urged close to the opposing faces the rotor and track ring by spring 30 and fluid pressure in cavities between backup plate 28 and shell 14, as will be described. Rotor 22 has a plurality of radially extending slots 46 disposed in an array about the periphery of the rotor. A flat generally rectangular vane 48 is slidably disposed within each slot 46. An undervane fluid pressure chamber 50 is formed at the radially inner edge of each slot 46 at a radius from the axis of rotation of rotor 20 for registry with a circumferential array of kidney slots 52, 53 in port plates 42, 44. A fluid passage 54 (FIG. 1) in backup plate 28 couples slots 52 to an annular cavity 56 between plate 28 and shell 14 for feeding fluid at second pass impeller discharge pressure to undervane chambers 50 and slots 52, and thereby urging vanes 48 radially outwardly with respect to rotor 22. Likewise, a fluid passage (not shown) in backup plate 28 couples slots 53 (FIG. 3) to the fluid outlet for feeding fluid at outlet pressure to the pump discharge.

Figure 2:
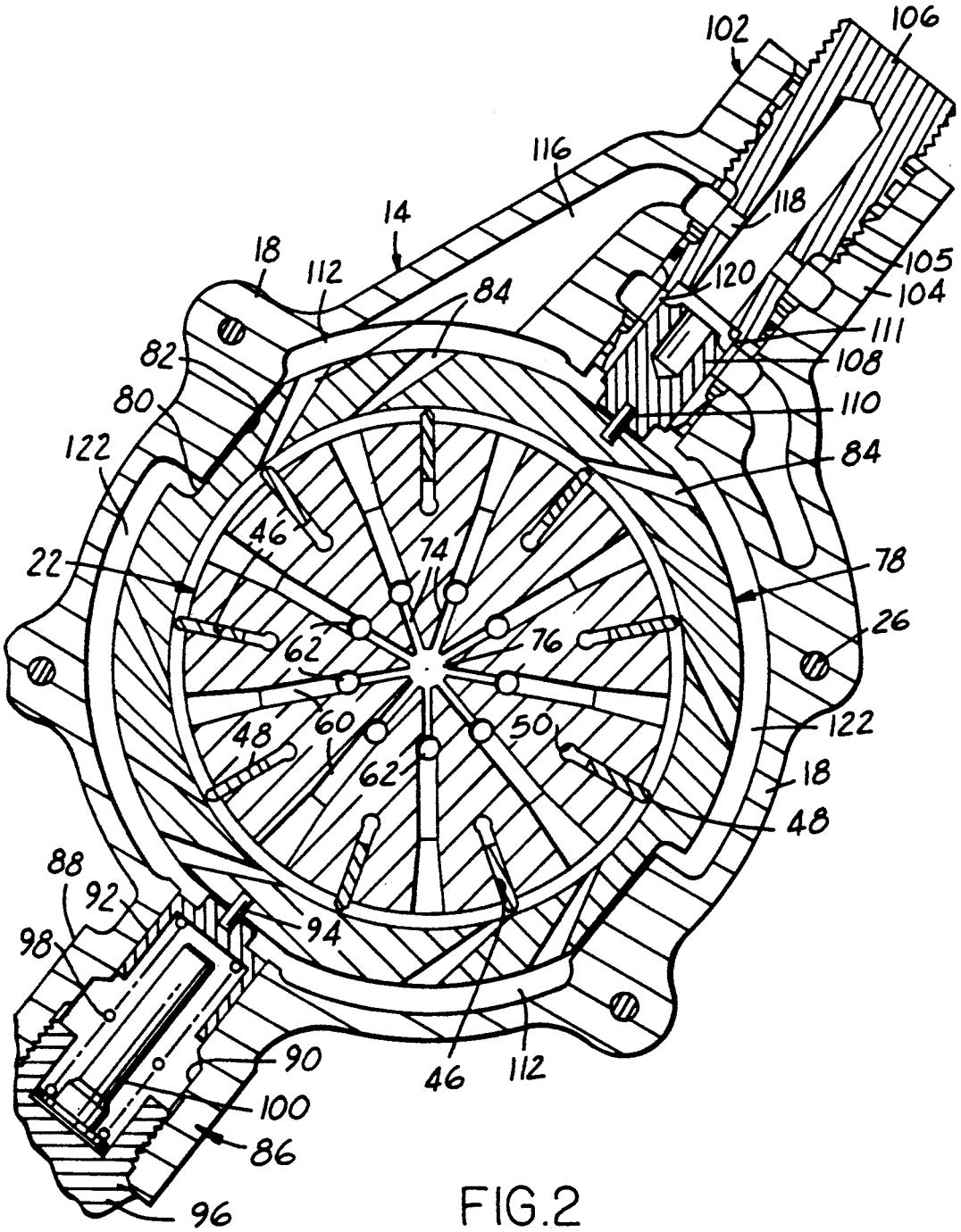

A plurality of radially extending passages 60 are formed internally of rotor 22 in a uniform circumferential array, one passage 60 being positioned midway between a pair of adjacent vane slots 46, as best seen in FIG. 2. The outer end of each rotor passage 60 flares outwardly and opens onto the periphery of rotor 22. The radially inner end of each rotor passage 60 is open to an axial passage 62 that extends entirely through the rotor body. Rotor passages 62 alternately register as the rotor rotates with slots 64, 65 (FIGS. 1 and 3) in port plates 42, 44. Slots 64 are key-shaped, while slots 65 are kidney-shape. Slots 64 communicate through a passage 67 in backup plate 28 with an annular cavity 66 surrounding shaft 20 adjacent to base 16 of shell 14 for feeding fluid at inlet pressure to cavity 66 and thereby assisting spring 30 in urging backup plate 28 toward rotor 20 and track ring 78. Annulus 72 is connected through passages (not shown) to cavities 122 (FIG. 2) accepting fluid from the first pass through the impeller. Annulus 56 is connected through passages (not shown) to cavities 112 (FIG. 2) accepting fluid from the second pass through the impeller. A further passage 70 shown in backup plate 28 couples slots 65 to cavity 72 for feeding fluid at intermediate pressure (first pass through the impeller) to allow the fluid to pass through the impeller a second time. The passage is through kidneys 65 to passages 60 to collection passageways 112. As will be observed in FIG. 1, the cavities 72, 56 and 66 are sealed from each other by the O-rings 32. A circumferential array of passages 74 extend radially inwardly from axial passages 62 in rotor 22 and interconnect rotor passages 60 with the hollow interior 76 of shaft 20.

A one-piece annular track ring 78 is captured between port plates 42, 44 surrounding the periphery of rotor 22. Track ring 78 is free to slide laterally of the axis of rotation of rotor 22, having diametrically opposed flats 80 (FIG. 2) that cooperate with opposing ledges 82 on shell 14 for guiding and restraining such lateral motion. A plurality of passages 84 are formed in ring 78, each passage 84 flaring outwardly of the ring body and being disposed at an angle with respect to the ring diameter. A spring actuator 86 (FIG. 2) comprises a collar 88 integral with shell 18 and having a radially orientated passage 90 extending therethrough. A cup-shaped piston 92 has a sidewall slidably captured within opening 90 and a base coupled by a sealing vane 94 to the opposed periphery of track ring 78. A cup-shaped spring seat 96 is adjustably threadably received into the outer end of opening 90, and captures a coil spring 98 in compression between seat 96 and piston 92. A guide pin 100 has a base captured between spring 98 and seat 96, and a pin body that extends coaxially through spring 98 for restraining lateral motion of the spring.

A fluid actuator 102 (FIG. 2) comprises a hollow collar 104 integral with shell 14 and having a radial through-passage diametrically aligned with passage 90 of collar 86 with respect to the axis of rotation of rotor 22. A hollow cup-shaped sleeve 106 is adjustably threadably received within passage 105. A fluid piston 108 is slidably carried at the inner end of sleeve 106 and is coupled by a sealing vane 110 to the opposing periphery of ring 78 diametrically opposite to vane 94 of spring actuator 86. An internal stop 111 within sleeve 106, cooperates with piston 108 for limiting outward motion of the latter and thereby limiting motion of ring 78 eccentrically of rotor 22 under force of spring actuator 86. A pair of diametrically opposed cavities 122 between ring 78 and shell 14 are connected to annulus 72 and to rotor passages 62 and kidneys 65 by passages 70. A second pair of diametrically opposed cavities 112 between ring 78 and shell 14 are interconnected by a channel (not shown) in front backup plate 28 and feed fluid under pressure to the control through passage 116. These passages 112 are also connected to annulus 56 for hydraulically clamping plate 28 through pins (not shown) to rear backup plate 24. Passage 116 extends from this channel into collar 104 from a cavity 112, and through openings 118 in sleeve 106 into the hollow interior thereof, so that pressurized fluid within cavities 112 is fed to actuator 102 and operates on actuator piston 108. An annular opening 120 in sleeve 106 is uncovered by motion of piston 108 to feed fluid from actuator 102 to the pump filter and to the pump outlet port (not shown). An open collar 124 on rear backup plate 24 forms the pump fluid inlet coaxially with shaft 20. An inducer 126 comprises a substantially cylindrical body 128 threadably received into shaft 20 coaxially therewith and positioned within inlet collar 124. A series of spiral vanes 130 radially integrally projects from body 128 to adjacent the inside diameter of collar 124.

Fluid enters pump inlet 124 (FIG. 1) and engages inducer 126, which boosts fluid pressure above inlet pressure. Fluid at such boosted pressure passes (from left to right in FIG. 1) through slot 64 in plate 44, through passages 62 in rotor 22, through slot 64 in plate 42 and through passage 67 in backup plate 28 to cavity 66 surrounding shaft 20. Such prepressurized fluid in cavity 66, pressurized by inducer 126, urges plate 28 against plate 42 through pins (not shown). At the same time, the prepressurized fluid from the inducer flows from impeller passages 62 radially outwardly through impeller passages 60 for the first time. The fluid exits the impeller and enters the chamber formed by the outside diameter of impeller 22 and the inside diameter of cam ring 78. This chamber is divided into pockets by the respective pairs of vanes, which port the fluid to successive diffuser passages 84.

Diffuser passages 84 around cam ring 78 are divided into four segments by the vane seals 110, 94 (FIG. 2) and by the surfaces 80, 82 for guiding sliding movement of the cam ring. Two of the segments 122 receive fluid with increased pressure caused by the momentum obtained from the first pass through the impeller (previously described). This fluid in cavities 122 is directed (by passages not shown) to chamber 72 (FIG. 1), and thence by passage 70 and slot 65 to passage 62 in impeller 22. The fluid thus again enters impeller passages 62, this time at intermediate pressure and flowing from right to left as shown in FIG. 1. This fluid at intermediate pressure is thus at higher pressure than the fluid that enters impeller passages 62 from inducer 126, so that fluid flows from the passages 62 at intermediate pressure to the passages 62 at lower pressure through the passages 74 (FIGS. 1 and 2) in shaft 20. Fluid exits passages 74 as an orifice, directing high velocity fluid into the rotor passage 60 that communicates with the inducer outlet. This high velocity discharge functions as an injector to enhanced flow of fluid from the inducer outlet through the impeller passages 60 during the first pass through the impeller.

In the meantime, fluid at intermediate pressure from cavity 72 and passage 70 also flows radially outwardly through impeller passages 60 so as to again exit the impeller into pockets formed by the respective pairs of vanes, the port plates, the impeller outside diameter and the cam ring inside diameter. These pockets communicate through diffuser passages 84 with the diametrically opposed chambers 112 external to the diffuser. This fluid is ported to annulus 56 by passages (not shown) in backup plate 28. Fluid in annulus 56 is fed by passage 54 and slots 52 to under-vane chambers 50 during that segment of impeller rotation in which the under-vane chambers are aligned with slots 52. This occurs during the portion of impeller rotation in which the vanes move outwardly to follow the opposing surface of the cam ring. The fluid thus enters the under-vane chambers as the vanes extend to follow the surface of the cam ring. As the vanes are forced in by the surface of cam ring 78 during the next portion of impeller rotation, the fluid is forced out of the under-vane chambers through the discharge slots 53. Fluid from discharge slots 53 is fed to the pump filter and pump outlet port (not shown).

In the meantime, as rotor speed increases, effective pressure of fluid in cavity 112, which has been twice subjected to centrifugal pumping action by passage through the rotor, correspondingly increases. When the pressure in chamber 112, in passage 116 and in passage 118 on valve piston 108 is sufficient to overcome the force of spring 98, piston 108 moves to unseat from sleeve 106, and to allow flow to pass through opening 120 and proceed to the filter and pump outlet. When valve 108 opens at a predetermined pressure referenced to the pump inlet, it also pushes cam ring 78 to cause it to move toward a position concentric with shaft 20. This motion eliminates the pumping action of vanes 48, thus terminating operation of the under-vane pumping function. The pump is then in a normal mode of operation in which centrifugal pumping action imparted by two passages through the impeller delivers the required engine fuel flow.

FIG. 4 is a graphic illustration of effective vane-pump output pressure 150 regulated by a pressure control valve (not shown) to the engine required pressure, vane pump displacement 152 controlled by actuator 108, centrifugal pump outlet pressure 154 determined by rotor (impeller) speed, and total pump output pressure 156, all as a function of pump speed (rpm). At a speed threshold 158, total pressure of outlet fluid is sufficient at actuator 102 to overcome spring actuator 86 and to position ring 78 coaxially with rotor 22, so that displacement 152 and effective vane pump outlet pressure 150 are zero.

Summarizing the foregoing discussion of fluid flow during the vane pump and centrifugal pump stages of operation, during the vane pump mode of operation, fluid flows from inducer 126 (FIG. 1) through slots 64 in plate 44, through passages 62 in rotor 22, through passage 64 in plate 42 (FIGS. 1 and 3), through passages 67 in plate 28, through cavity 66 between plate 28 and housing 14. The fluid also flows from 62 through radial holes 60, diffusers 84, to collectors 122 to annulus 72, through passage 70 to slot 65 to re-enter passages 62 in rotor 22, through radial holes 60 to collector 112, hence to annulus 56, through port 54, through slots 52 in plate 42 into undervane chambers 50 as vanes 48 move radially outwardly following cam ring/diffuser 78. As the vanes are moved radially inwardly by the cam ring/diffuser, fluid is pumped by the piston action of the vanes from undervane chambers 50 through slots 53 in plate 42 to cavity 120, and thence to the pump outlet. Pumping action is thus obtained during the vane pump mode of operation due to piston action of the vanes moving up and down in the rotor slots following the eccentrically positioned cam ring/diffuser as the rotor rotates. Vane pump displacement 152 (FIGS. 4) decreases as pump speed and pressure urge cam ring/diffuser 78 toward the centered position illustrated in FIG. 2.

On the other hand, the centrifugal pumping action is obtained as speed increases by flow from inducer 126 through slots 64 in plate 44, through passages 60 in rotor 22 into chamber 122 (FIG. 2) through diffuser 84. From chamber 122, fluid flows to annulus 72, through a passage not shown, then again through passages 60 in rotor 22 into chamber 112 through diffuser 84, and thence through cavity 120 to the pump outlet. There is thus obtained a double centrifugal pumping action in the centrifugal pump mode of operation.

The invention claimed is:

1. A combined centrifugal and vane-type rotary hydraulic pump that comprises:

a housing having a fluid inlet and a fluid outlet, a rotor mounted for rotation within said housing, said rotor having a plurality of radially extending peripheral slots, an undervane chamber at a radially inner end of each said slot, and a plurality of internal passages extending radially through said rotor from an open outer end at a periphery of said rotor to an open inner end, a plurality of vanes individually slidably mounted in said slots, an annular track ring movably mounted within said housing, said track ring having a radially inner surface surrounding said rotor and forming a fluid cavity between said surface and said rotor, a drive shaft coupled to said rotor and extending out of said housing, fluid inlet passage means in said housing connecting said inlet to said open inner ends of said rotor passages such that fluid is centrifugally pumped through said rotor passages to said fluid cavity by rotation of said rotor and shaft, fluid passage means to undervane inlet port means in said housing for connecting said fluid cavity to said undervane chambers in sequence as said rotor rotates within said housing, fluid outlet passage means including first outlet port means in said housing spaced from said undervane inlet port means and connecting said fluid outlet to said undervane chambers in sequence as said rotor rotates within said housing, and second outlet port means connecting said outlet to said fluid cavity, and means within said housing coupled to said ring and responsive to pressure of fluid fed to said outlet for adjustably positioning said track ring within said housing, and thereby controlling displacement of said vanes within said slots, as a function of outlet pressure, such that fluid pressure at said outlet varies as a combined function of piston pumping of said vanes through radial displacement in said slots and centrifugal pumping of fluid through said rotor passages.

2. The pump set forth in claim 1 further comprising means at said fluid inlet coupled to said shaft for boosting pressure of fluid fed from said inlet to said inlet passage means.

3. The pump set forth in claim 2 wherein said inlet includes a chamber coaxial with said shaft, and wherein said pressure-boosting means comprises a spiral inducer positioned within said chamber and coupled to said shaft.

4. The pump set forth in claim 1 wherein said housing includes means coupled to said ring for enabling motion of said ring radially of said rotor under control of said pressure-responsive means while restraining said ring from rotation within said housing about said rotor.

5. The pump set forth in claim 1 further comprising at least one outlet cavity positioned radially externally of said ring, and passages extending radially through said ring for diffusing flow of fluid under pressure to said outlet cavity from said cavity between said rotor and said ring, said second outlet port means comprising means connecting said outlet cavity to said outlet.

6. The pump set forth in claim 5 wherein said at least one outlet cavity comprises first and second circumferentially spaced outlet cavities, wherein said inlet passage means comprises means connecting said inlet to said open inner ends radially inwardly of said first outlet cavity, and wherein said pump further comprises third port means in said housing connecting said first outlet cavity to open inner ends of said rotor passages radially inwardly of said second outlet cavity, such that fluid flowing from said inlet to said outlet through said rotor passages is twice subjected to centrifugal pumping at said rotor, first during passage from said inlet passage means through said rotor passages to said first outlet cavity, and second during passage from said first outlet cavity through said third port means and said rotor passages to said second outlet cavity.

7. The pump set forth in claim 6 wherein said at least one outlet cavity comprises a diametrically opposed pair of said first cavities and a diametrically opposed pair of said second cavities circumferentially staggered around said rotor.

8. The pump set forth in claim 6 further comprising passages in said rotor interconnecting said open inner ends of said rotor passages for boosting fluid flow from said inlet passage means to said rotor passages.

9. The pump set forth in claim 6 wherein said pressure-responsive means comprises spring means carried by said housing and urging said track ring to a position eccentric to said rotor, and fluid actuator means coupled to said track ring and responsive to fluid pressure at said outlet for moving said track ring against force of said spring means toward a position coaxial with said rotor.

10. The pump set forth in claim 9 wherein said spring means comprises a spring actuator including a first piston radially slidably mounted in said housing and coupled to said track ring, and a coil spring having a radially oriented axis and captured in compression between a spring seat in said housing and said first piston.

11. The pump set forth in claim 10 wherein said fluid actuator means comprises a hydraulic fluid actuator including a second piston radially slidably mounted in said housing and coupled to said track ring in diametric opposition to said first piston.

12. A combined centrifugal and vane-type rotary hydraulic pump that comprises:

a housing including opposed spaced backup plate means, a rotor mounted for rotation within said housing between said backup plate means, said rotor having a plurality of radially extending peripheral slots, a fluid undervane chamber at a radially inner end of each said slot, and a plurality of internal passages extending radially from an open outer end at a periphery of said rotor to an inner end, said slots and said passages in said rotor alternating with each other circumferentially of said rotor at uniform spacing, a plurality of vanes individually slidably mounted in said slots, an annular track ring movably mounted between said backup plate means within said housing, said track ring having a radially inner surface surrounding said rotor and forming a ring/rotor cavity between said surface and said rotor, and a plurality of radially angulated passages extending through said ring, a drive shaft coupled to said rotor and extending from said housing through one of said backup means, a pump inlet in the other of said backup means coaxial with said shaft, a pump outlet in said housing, a spiral inducer coupled to said shaft and positioned in said inlet for pressurizing fluid at said inlet, inlet fluid passage means in said backup means extending from said inducer to first port means in facing engagement with said rotor for feeding fluid under pressure from said inducer to said inner ends of said rotor passages such that fluid is centrifugally pumped through said rotor passages to said ring/rotor cavity by rotation of said rotor and shaft, an outlet cavity in said housing radially external to said ring, means coupling said outlet cavity through said backup means to a first circumferentially adjacent array of said undervane chambers for urging said vanes radially outwardly toward said ring surface, second port means in facing engagement with said rotor for feeding fluid from a second circumferential array of said undervane chambers to said outlet, and means for connecting said pump outlet to said outlet cavity in parallel with said second port means, and means coupled to said ring and responsive to fluid pressure at said outlet for adjustably positioning said ring within said housing, and thereby controlling displacement of said vanes within said slots, as a function of outlet fluid pressure, such that fluid pressure at said outlet varies as a combined function of piston pumping of said vanes through radial displacement in said slots and centrifugal pumping of fluid through said rotor passages.

13. The pump set forth in claim 12 wherein said pressure-responsive means comprises spring means carried by said housing and urging said track ring to a position eccentric to said rotor, and fluid actuator means coupled to said track ring and responsive to fluid pressure at said outlet for moving said track ring against force of said spring means toward a position coaxial with said rotor.

14. The machine set forth in claim 13 wherein said spring means comprises a spring actuator including a first piston radially slidably mounted in said housing and coupled to said track ring, and a coil spring having a radially oriented axis and captured in compression between a spring seat in said housing and said first piston.

15. The machine set forth in claim 14 wherein said fluid actuator means comprises a hydraulic fluid actuator including a second piston radially slidably mounted in said housing and coupled to said track ring in diametric opposition to said first piston.

* * * * *